US011587717B2

(12) United States Patent
Wang et al.

(10) Patent No.: US 11,587,717 B2
(45) Date of Patent: Feb. 21, 2023

(54) INDUCTOR ELEMENT

(71) Applicant: TDK CORPORATION, Tokyo (JP)

(72) Inventors: Chen Wang, Tokyo (JP); Satoshi Sugimoto, Tokyo (JP)

(73) Assignee: TDK CORPORATION, Tokyo (JP)

( * ) Notice: Subject to any disclaimer, the term of this patent is extended or adjusted under 35 U.S.C. 154(b) by 658 days.

(21) Appl. No.: 16/196,603

(22) Filed: Nov. 20, 2018

(65) Prior Publication Data

US 2019/0214181 A1 Jul. 11, 2019

(30) Foreign Application Priority Data

Jan. 10, 2018 (JP) ..... JP2018-002040

(51) Int. Cl.

| | |
|---|---|
| ***H01F 27/26*** | (2006.01) |
| ***H01F 27/02*** | (2006.01) |
| ***H01F 27/28*** | (2006.01) |
| ***H01F 27/30*** | (2006.01) |
| ***H01F 3/14*** | (2006.01) |
| ***H01F 17/04*** | (2006.01) |

(52) U.S. Cl.

CPC ..... *H01F 27/266* (2013.01); *H01F 3/14* (2013.01); *H01F 17/04* (2013.01); *H01F 27/022* (2013.01); *H01F 27/263* (2013.01); *H01F 27/2823* (2013.01); *H01F 27/2852* (2013.01); *H01F 27/306* (2013.01)

(58) Field of Classification Search

CPC ... H01F 27/266; H01F 27/022; H01F 27/2823
USPC ..... 336/65
See application file for complete search history.

(56) References Cited

U.S. PATENT DOCUMENTS 6,885,274 B2 * 4/2005 Hsu ..... H01F 27/292 336/182
7,259,650 B2 * 8/2007 Sano ..... H01F 27/366 336/212
7,345,566 B2 * 3/2008 Urano ..... H01F 17/043 336/212

(Continued)

FOREIGN PATENT DOCUMENTS

CN 211929256 U * 11/2020
EP 1113464 A2 * 7/2001 ..... H01F 27/263

(Continued)

*Primary Examiner* — Elvin G Enad
*Assistant Examiner* — Joselito S. Baisa
(74) *Attorney, Agent, or Firm* — Oliff PLC

(57) ABSTRACT

An inductor element includes a first conductive portion, a second conductive portion, and a magnetic core. The first conductive portion includes a first round-about portion, a first mount portion, and a second mount portion. The second conductive portion includes a second round-about portion, a third mount portion, and a fourth mount portion. The magnetic core houses at least a part of the first and second conductive portions so that each mount surface of the first to fourth mount portions is exposed from one side of the magnetic core. The first and second conductive portions are arranged so that the first and second directions are substantially parallel and opposite to each other. The first and third mount portions are at least partially overlapped with each other in a third direction perpendicular to the first and second directions.

12 Claims, 14 Drawing Sheets

(56) References Cited

U.S. PATENT DOCUMENTS 7,598,837 B2 * 10/2009 Gilmartin ..... H01F 27/29 336/192
7,772,955 B1 * 8/2010 Li ..... H02M 1/14 336/200
7,864,016 B1 * 1/2011 Li ..... H02M 3/00 336/200
8,299,882 B2 * 10/2012 Ikriannikov ..... H01F 27/306 336/192
8,767,947 B1 * 7/2014 Ristock ..... G06Q 10/0631 379/266.08
8,975,995 B1 * 3/2015 Ikriannikov ..... H01F 3/10 336/200
9,842,682 B2 * 12/2017 Yan ..... H01F 27/263
2008/0012674 A1 1/2008 Sano et al.
2008/0246577 A1 * 10/2008 Sullivan ..... H02M 7/003 336/184
2011/0032068 A1 * 2/2011 Ikriannikov ..... H01F 3/10 336/221
2011/0043317 A1 * 2/2011 Ikriannikov ..... H01F 17/06 336/192
2013/0033351 A1 * 2/2013 Kim ..... H01F 27/38 336/170
2013/0293207 A1 * 11/2013 Wei ..... H02M 3/1584 323/272
2016/0307692 A1 * 10/2016 Zhou ..... H01F 27/306
2017/0178784 A1 * 6/2017 Janis ..... H01F 27/292
2017/0178794 A1 * 6/2017 Yan ..... H01F 41/02
2019/0312516 A1 * 10/2019 Yang ..... H02M 3/337
2020/0027642 A1 * 1/2020 Tsai ..... H01F 27/40

FOREIGN PATENT DOCUMENTS

JP 2003017334 A * 1/2003
WO 2006/070544 A1 7/2006
WO WO-2017107039 A1 * 6/2017 ..... H01F 27/263

* cited by examiner

INDUCTOR ELEMENT

BACKGROUND OF THE INVENTION

The present invention relates to an inductor element used for electronic circuits or so.

As inductor elements responsible to a high electric current, having a comparatively low L value, and required for high magnetic saturation characteristics, proposed is an inductor element where a conductor having less than 1 T is covered with a magnetic material. As one of these inductor elements, also proposed is an inductor element containing a plurality of mutually independent conductors. In such an inductor element containing a plurality of conductors, the conductors are electrically connected via a mount board, and an inductance value similar to that of an element with a conductor having 1 T or more can be achieved.

Patent Document 1: WO2006070544 (Al)

BRIEF SUMMARY OF INVENTION

In conventional inductor elements containing a plurality of conductors, however, a land pattern for connecting the conductors has a complicated shape, and there is a problem with downsizing and reduction of resistance value.

The present invention has been achieved under such circumstances. It is an object of the invention to provide an inductor element capable of being mounted using a simple land pattern and being advantageous in downsizing.

To achieve the above object, an inductor element according to the present invention includes:

a first conductive portion including:

a first round-about portion connecting a first end and a second end in a round-about manner;

a first mount portion connected to the first round-about portion at the first end and extending from the first end in a first direction linearly passing through the second end from the first end; ands a second mount portion connected to the first round-about portion at the second end and extending from the second end in the first direction;

a second conductive portion including:

a second round-about portion connecting a third end and a fourth end in a round-about manner;

a third mount portion connected to the second round-about portion at the third end and extending from the third end in a second direction linearly passing through the fourth end from the third end; and a fourth mount portion connected to the second round-about portion at the fourth end and extending from the fourth end in the second direction; and a magnetic core configured to house at least a part of the first conductive portion and the second conductive portion so that each mount surface of the first to fourth mount portions is exposed from one side of the magnetic core, wherein the first conductive portion and the second conductive portion are arranged so that the first direction and the second direction are substantially parallel and opposite to each other, and wherein the first mount portion and the third mount portion are at least partially overlapped with each other in a third direction perpendicular to the first direction and the second direction.

Since the first mount portion of the first conductive portion and the third mount portion of the second conductive portion are overlapped with each other in the third direction, the inductor element according to the present invention can be mounted using a simple land pattern and is advantageous in downsizing. Since the distance between the first mount portion and the third mount portion can be reduced compared to prior arts, it is possible to prevent the increase in resistance value caused by flow of electric current in the land pattern.

For example, the magnetic core may include: a pair of side-wall portions sandwiching the first conductive portion and the second conductive portion from both sides of the third direction; an inner core portion connecting the pair of side-wall portions on the inside of the first conductive portion and the second conductive portion; and a side circumferential portion connecting the pair of side-wall portions on the outside of the first conductive portion and the second conductive portion, and a magnetic gap may be formed in the inner core portion.

For example, the magnetic core may include: a pair of side-wall portions sandwiching the first conductive portion and the second conductive portion from both sides of the third direction; an inner core portion connecting the pair of side-wall portions on the inside of the first conductive portion and the second conductive portion; and a side circumferential portion connecting the pair of side-wall portions on the outside of the first conductive portion and the second conductive portion, and a magnetic gap may be formed in the side circumferential portion.

In this inductor element, a magnetic circuit is formed on the inside of the magnetic core by the pair of side-wall portions, the inner core portion, and the side circumferential portion, and a magnetic gap is further formed in the inner core portion or the side circumferential portion, whereby high magnetic saturation characteristics are demonstrated.

For example, the magnetic core may include an upper opening formed opposite to the side where each mount surface of the first to fourth mount portions is exposed.

The magnetic core including the upper opening is advantageous in low profile and heat dissipation characteristics.

For example, the upper opening may be covered with a tape member.

The inductor element including the upper opening covered with the tape member is easily attached and held by a mounter for mounting inductor elements and is thereby excellent in mounting performance.

For example, the first conductive portion and the second conductive portion may have the same exterior shape and may be arranged symmetrically to each other.

When the first conductive portion and the second conductive portion have the same exterior shape, the types of parts can be reduced, and this inductor element has a favorable productivity and can reduce manufacturing cost.

For example, mount surfaces of the second and fourth mount portions may be wider than those of the first and third mount portions in the third direction.

The inductor element including the mount surfaces is stable and hard to fall down while being placed with mount posture and thereby has a favorable mounting performance.

For example, mount surfaces of the first and third mount portions may be longer than those of the second and fourth mount portions in the first or second direction.

In the inductor element including the mount surfaces, the first and third mount portions can have a large overlapping length in the third direction. Thus, this inductor element is more allowable for manufacturing error of arrangement of the first and second conductive portions and is advantageous in downsizing.

For example, the first conductive portion and the second conductive portion may be a rectangular wire or a bent conductive plate.

This inductor element can be smaller and reduce resistance value by increasing the density of the conductive portions and is connected to a land for mounting via planes. Thus, this inductor element exhibits a favorable mounting strength.

DETAILED DESCRIPTION OF INVENTION

First Embodiment

Figure 1:
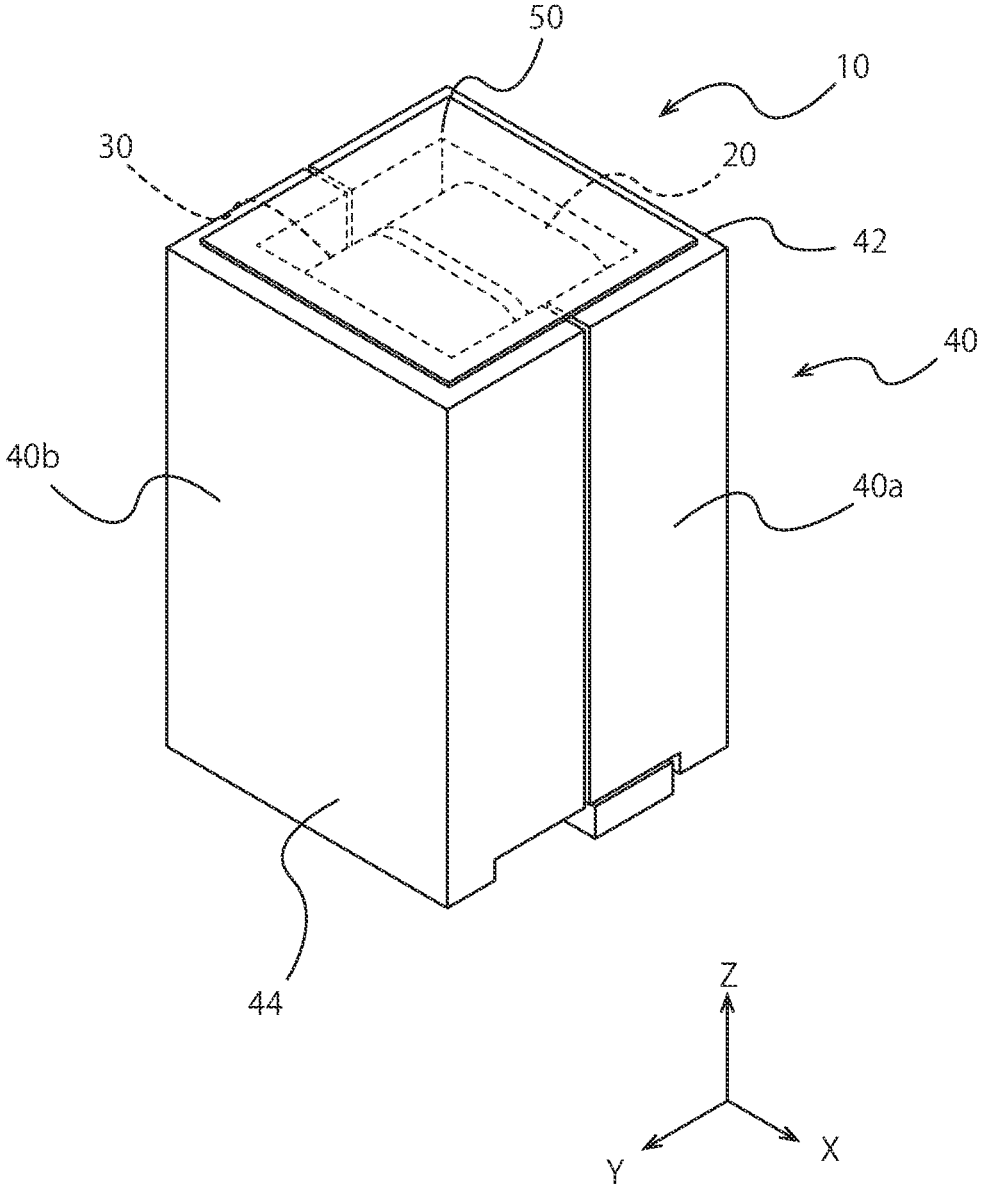
FIG. 1 is a perspective view of an inductor element according to First Embodiment of the present invention seen from diagonally above.

FIG. 1 is a perspective view of an inductor element 10 according to First Embodiment of the present invention from diagonally above. The inductor element 10 has a roughly cuboid outer shape and is used by being mounted on a mount board with a posture where mount surfaces 24*a*, 26*a*, 34*a*, and 36*a* forming the bottom of the inductor element 10 in the negative side of the Z-axis direction (see FIG. 5) face lands. In the explanation of the inductor element 10, the Z-axis direction is a normal direction of the a mount surface, the X-axis direction is a perpendicular direction to the Z-axis direction and is a parallel direction to first and second side-wall portions 42 and 44 of a magnetic core 40, and the Y-axis direction is a perpendicular direction to the Z-axis direction and is a normal direction of the first and second side-wall portions 42 and 44 of the magnetic core 40.

Figure 5:
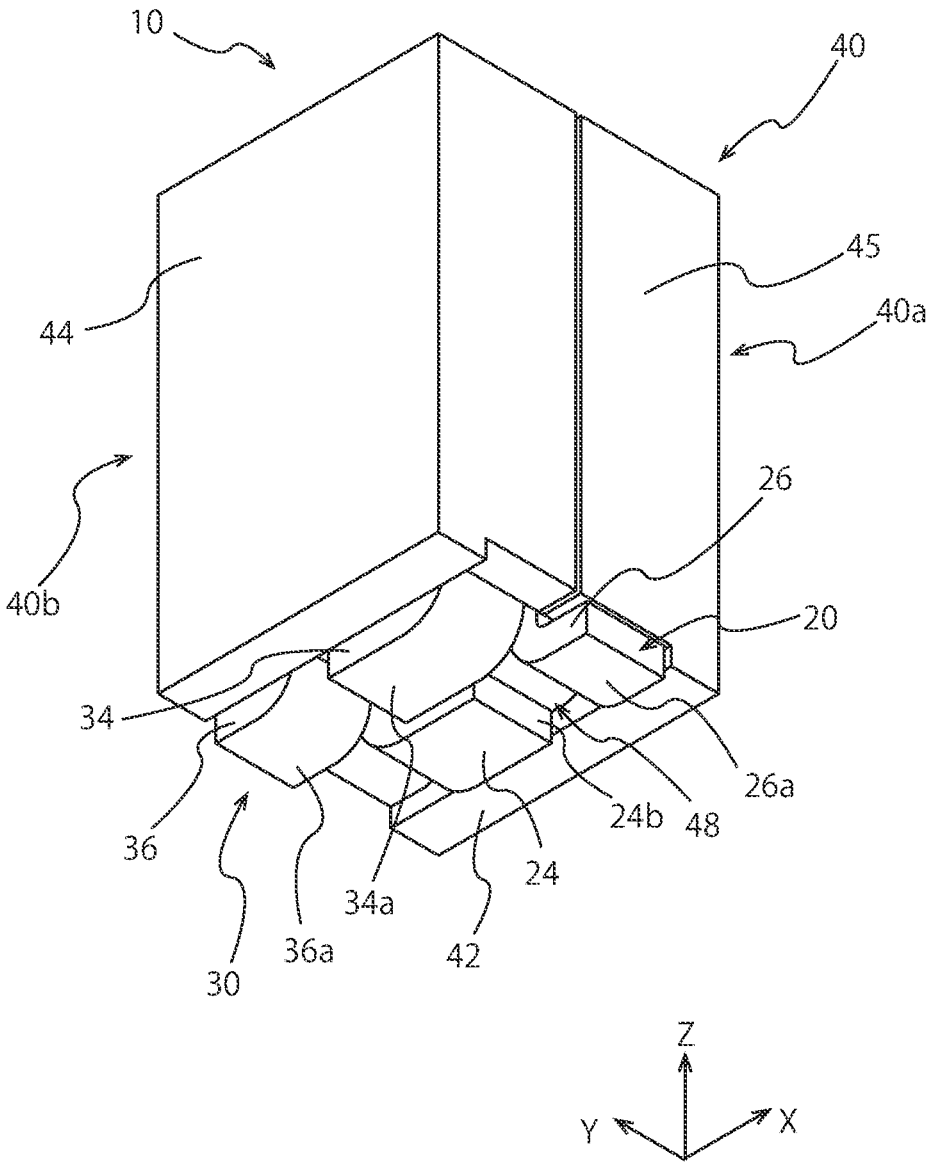
FIG. 5 is a perspective view of the inductor element shown in FIG. 1 seen from diagonally below.

As shown in FIG. 1, the inductor element 10 includes the magnetic core 40 and first and second conductive portions 20 and 30 (conductors). As shown in FIG. 5 (a perspective view of the inductor element 10 from diagonally below), the first and second conductive portions 20 and 30 are housed in the magnetic core 40 except for mount portions 24, 26, 34, and 36 exposed toward below the inductor element 10 (see FIG. 5).

The inductor element 10 has any size (outer dimension) as long as the inductor element 10 can be mounted on a board with a land. For example, the inductor element 10 has a length of 3 to 20 mm in the X-axis direction, a length of 3 to 20 mm in the Y-axis direction, and a length of 3 to 20 mm in the Z-axis direction.

Figure 8:
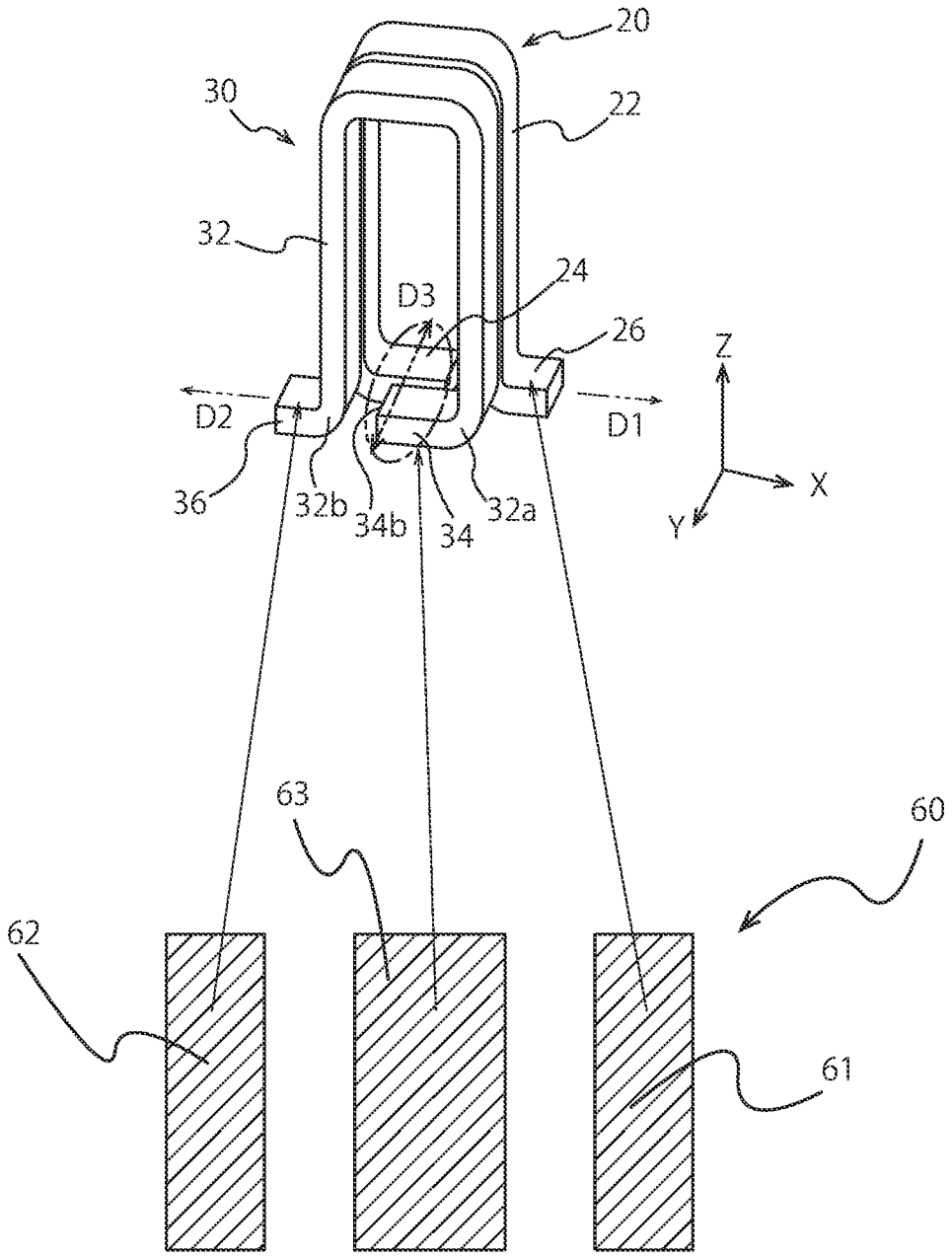
FIG. 8 is a conceptual view illustrating first and second mount portions housed in the inductor element shown in FIG. 1 and land shapes where the inductor element is mounted.

FIG. 8 is a perspective view of the first and second conductive portions 20 and 30 housed in the magnetic core 40. As shown in FIG. 8, the first and second conductive portions 20 and 30 are arranged so that a first round-about portion 22 and a second round-about portion 32 are overlapped with each other in the Y-axis direction in the magnetic core 40.

Figure 7:
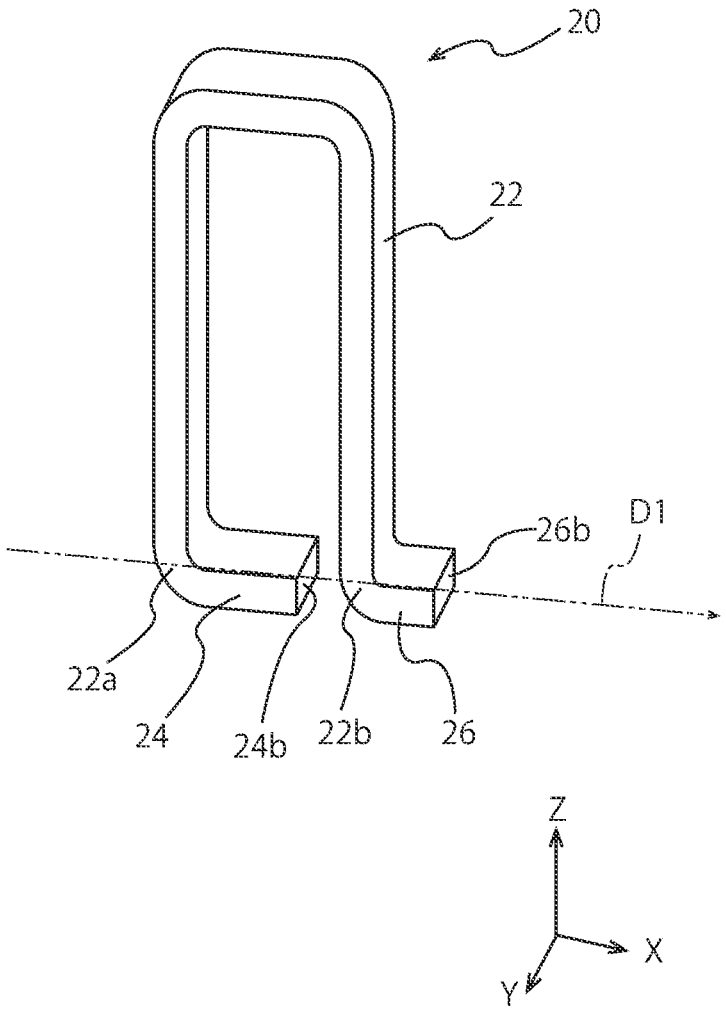
FIG. 7 is an exterior perspective view illustrating a first conductor portion housed in the inductor element shown in FIG. 1.

FIG. 7 is a perspective view of the first conductive portion 20 housed in the inductor element 10. The first conductive portion 20 includes three portions of the first round-about portion 22, the first mount portion 24, and the second mount portion 26. The first conductive portion 20 can be manufactured by, for example, bending a rectangular wire or a conductive plate into a predetermined shape. The first conductive portion 20 is manufactured by any material, such as a good conductor of copper, copper alloy, silver, nickel, etc. An insulation cover of resin or so may be formed on the surface of the first conductive portion 20, but may not be formed if the first conductive portion 20 is insulated with the second conductive portion 30 on the inside of the inductor element 10.

The first conductive portion 20 shown in FIG. 7 has a rectangular cross-sectional shape, but the first conductive portion 20 may have a cross section of oval, ellipse, circle, etc. In particular, when the first conductive portion 20 has a cross section of rectangle or oval, mount surfaces (lower surfaces of the first mount portion 24 and the second mount portion 26) are planes and joined with a land for mounting on their planes, and the inductor element 10 can thereby improve a joint strength during mounting.

The first conductive portion 20 has a cross-sectional area appropriately determined based on a value of electric current flowing the first conductive portion 20, a size of the inductor element 10, and the like. For example, the first conductive portion 20 may have a cross-sectional area of about 0.1 to 10 $mm^2$.

The first round-about portion 22 of the first conductive portion 20 connects between a first end 22*a* (one end of the first round-about portion 22) and a second end 22*b* (the other end of the first round-about portion 22) in a round-about manner, not linearly. The first round-about portion 22 shown in FIG. 7 has an approximately U shape, but the first round-about portion 22 may have any other shapes of backwards C shape, C shape, V shape, etc. The first round-about portion 22 is disposed so that the first end 22*a* and the second end 22*b* (both ends) face downward (negative side of the Z-axis direction).

The first mount portion 24 of the first conductive portion 20 is connected to the first round-about portion 22 at the first end 22*a* (one end of the first round-about portion 22). The first mount portion 24 extends from the first end 22*a* in a first direction D1 (a direction linearly passing through the second end 22*b* from the first end 22*a* of the first round-about portion 22).

As shown in FIG. 7, the base of the first mount portion 24 is connected to the first end 22*a* of the first round-about portion 22, and a tip 24*b* of the first mount portion 24 is positioned between the first end 22*a* and the second end 22*b*. The first direction D1 (a direction where the first mount portion 24 extends) is parallel to the X-axis direction of the inductor element 10 and faces the same direction as the positive side of the X-axis direction. The tip 24*b* of the first mount portion 24 is separated from the second end 22*b* and the second mount portion 26 and is not in contact therewith, but the tip 24*b* of the first mount portion 24 is located closer to the second end 22*b* than a middle point of a straight line connecting the first end 22*a* and the second end 22*b*.

The second mount portion 26 of the first conductive portion 20 is connected to the first round-about portion 22 at the second end 22*b* (the other end of the first round-about portion 22). The second mount portion 26 extends from the second end 22*b* in the first direction D1.

As shown in FIG. 7, the base of the second mount portion 26 is connected to the second end 22*b* of the first round-about portion 22, and a tip 26*b* of the second mount portion 26 is further separated from the first end 22*a* compared to the second end 22*b*. The first mount portion 24 and the second mount portion 26 extend toward the same direction along an identical line connecting the first end 22*a* and the second end 22*b*.

As shown in FIG. 8, the second conductive portion 30 has the same shape as the first conductive portion 20 and includes a second round-about portion 32 corresponding to the first round-about portion 22, a third mount portion 34 corresponding to the first mount portion 24, and a fourth mount portion 36 corresponding to the second mount portion 26. The second conductive portion 30 is disposed symmetrically to the first conductive portion 20 in the Y-axis direction.

As shown in FIG. 8, the second round-about portion 32 of the second conductive portion 30 connects between a third end 32*a* (one end of the second round-about portion 32) and a fourth end 32*b* (the other end of the second round-about portion 32) in a round-about manner, not linearly. The third mount portion 34 of the second conductive portion 30 is connected to the second round-about portion 32 at the third end 32*a* and extends from the third end 32*a* in a second direction D2 (a direction linearly passing through the fourth end 32*b* from the third end 32*a* of the second round-about portion 32).

The base of the third mount portion 34 is connected to the third end 32*a* of the second round-about portion 32, and a tip 34*b* of the third mount portion 34 is positioned between the third end 32*a* and the fourth end 32*b*. The second direction D2 (a direction where the third mount portion 34 extends) is parallel to the X-axis direction of the inductor element 10 and faces the same direction as the negative side of the X-axis direction. The tip 34*b* of the third mount portion 34 is separated from the fourth end 32*b* and the fourth mount portion 36 and is not in contact therewith, but the tip 34*b* of the third mount portion 34 is located closer to the fourth end 32*b* than a middle point of a straight line connecting the third end 32*a* and the fourth end 32*b*.

Figure 4:
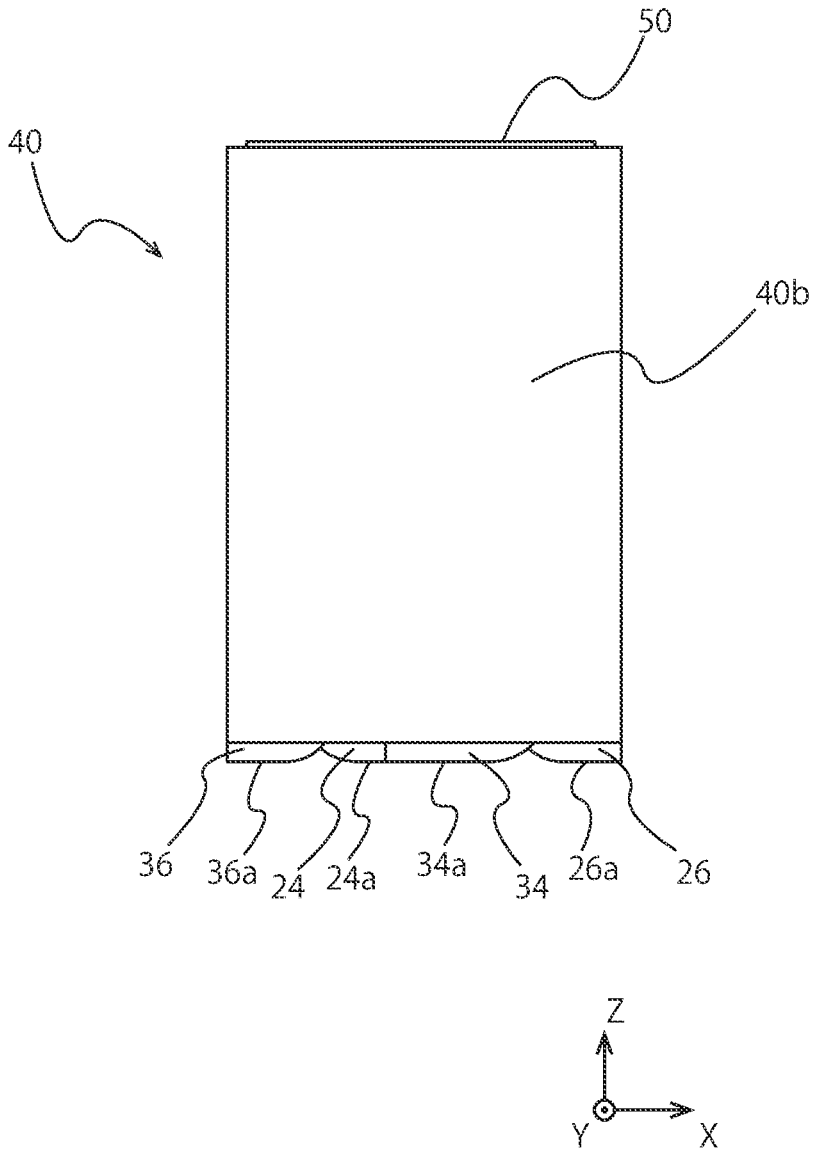
FIG. 4 is a left-side view of the inductor element shown in FIG. 1.
Figure 6:
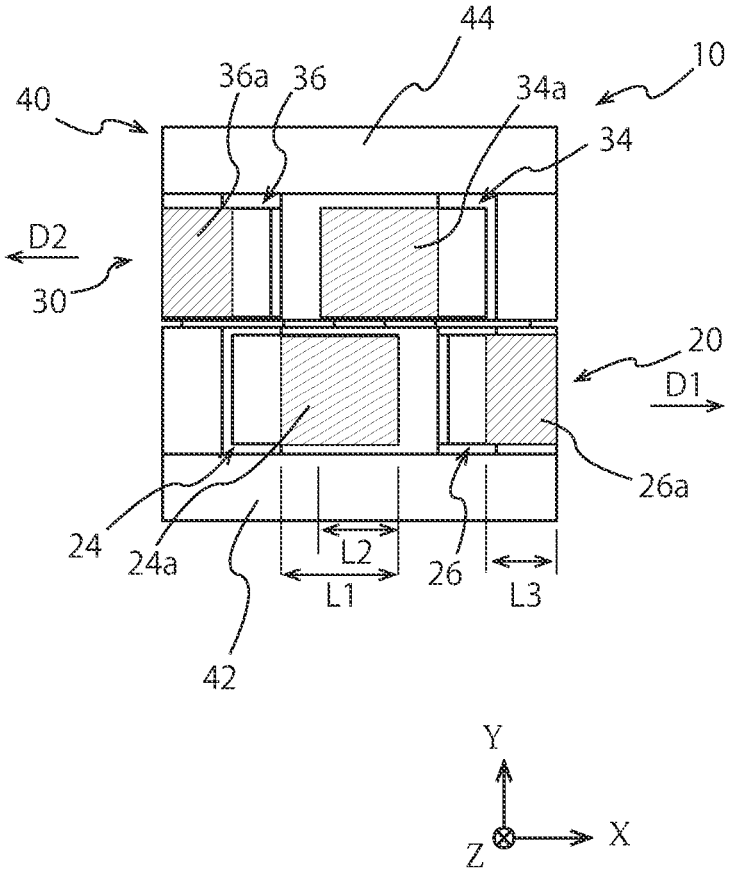
FIG. 6 is a bottom view of the inductor element shown in FIG. 1.

As shown in FIG. 8, the first conductive portion 20 and the second conductive portion 30 are arranged with a predetermined distance so that the first direction D1 and the second direction D2 are substantially parallel to each other and are opposite directions. FIG. 6 is a bottom view of the inductor element 10 seen from the negative side of the Z-axis direction and illustrates an arrangement of the first to fourth mount surfaces 24*a*, 26*a*, 34*a*, and 36*a* (bottom surfaces of the first to fourth mount portions 24, 26, 34, and 36). As shown in FIG. 4, the first to fourth mount portions 24, 26, 34, and 36 of the inductor element 10 are exposed from the magnetic core 40 toward below (negative side of the Z-axis direction), arranged on an approximately same plane, and form an entire bottom surface of the inductor element 10.

As shown in FIG. 6, the first mount portion 24 and the third mount portion 34 are at least partially overlapped with each other in a third direction D3 perpendicular to the first direction D1 and the second direction D2. The first mount surface 24*a* and the third mount surface 34*a* partially overlap with each other in the third direction D3. A length L2 in the X-axis direction of the overlapping part of the first mount surface 24*a* and the third mount surface 34*a* in the third direction D3 may be, for example, about ¼ to ¾ of a length L1 in the X-axis direction of the first mount surface 24*a* and the third mount surface 34*a* (a length in the first direction D1 or a length in the second direction D2). A length L1 in the X-axis direction of the first mount surface 24*a* and the third mount surface 34*a* or a length L2 in the X-axis direction of the overlapping part of the first mount surface 24*a* and the third mount surface 34*a* may be equal to or larger than a length L3 in the X-axis direction of the second mount surface 26*a* and the fourth mount surface 36*a*. When the first mount surface 24*a* and the third mount surface 34*a* have a large length L1 in the X-axis direction, a resistance value of the inductor element 10 during mounting can be prevented from increasing.

Since the mount portions 24, 26, 34, and 36 are arranged as shown in FIG. 6, the inductor element 10 is mounted on a conductor pattern 60 including a first land 61, a second land 62, and a third land 63 as shown in FIG. 8 and has an L value that is equal to an L value of a coil having more than 1 T and less than 2 T (about 1.8 T in FIG. 8). That is, both of the first conductive portion 20 and the second conductive portion 30 housed in the magnetic core 40 have less than 1 T and are not electrically connected to each other on the inside of the inductor element 10.

When the inductor element 10 is mounted on a board having the conductor pattern 60 as shown in FIG. 8, however, the first mount portion 24 of the first conductive portion 20 and the third mount portion 34 of the second conductive portion 30 are thereby joined on the single third land 63. Thus, the first conductive portion 20 and the second conductive portion 30 have a structure equivalent to a structure of a coil that is right-handed seen from the positive side of the Y-axis direction and has about 1.8 T. Similarly to the first land 61 and the second land 62 to be joined with the second and fourth mount portions 26 and 36 functioning as input and output terminals to and from the inductor element 10, the third land 63 can have a simple rectangular shape. Since the first mount portion 24 and the third mount portion 34 are overlapped with each other in the third direction D3, it is possible to decrease a resistance value of a portion connecting between the first mount portion 24 and the third mount portion 34 (a resistance value of a portion of the third land pattern where an electric current actually flows).

As shown in FIG. 1, the magnetic core 40 has a roughly cuboid outer shape and houses at least a part of the first and second conductive portions 20 and 30 shown in FIG. 8. As shown in FIG. 5, among the first and second conductive portions 20 and 30, the magnetic core 40 houses the whole of the first round-about portion 22 and the second round-about portion 32 and a part of the first to fourth mount portions 24, 26, 34, and 36.

As shown in FIG. 5, the other part of the first to fourth mount portions 24, 26, 34, and 36 is exposed on the outside of the magnetic core 40. That is, each of the mount surfaces 24*a*, 26*a*, 34*a*, and 36*a* of the first to fourth mount portions 24, 26, 34, and 36 is exposed from a lower opening 48 formed on one side of the magnetic core 40.

Figure 10:
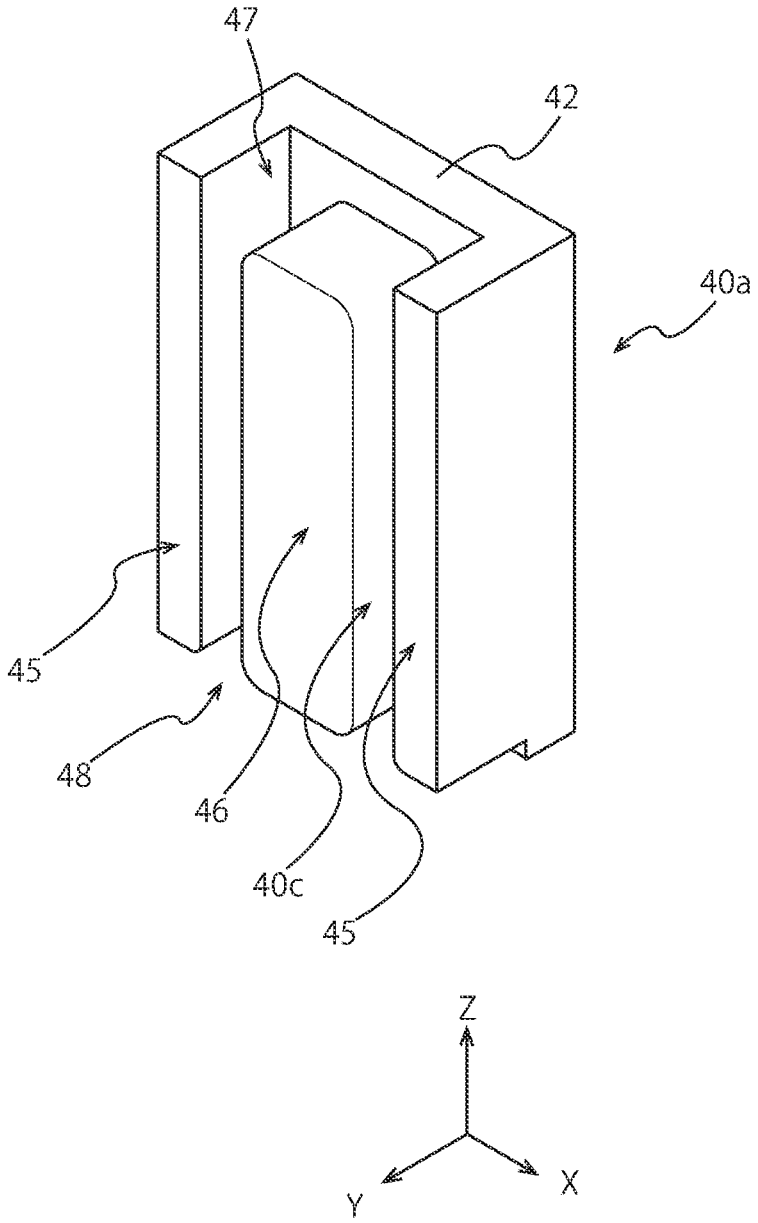
FIG. 10 is an exterior view of a first core portion housed in a magnetic core of the inductor element shown in FIG. 1.

As shown in FIG. 1, the magnetic core 40 is formed by combining two portions of a first core portion 40*a* and a second core portion 40*b*. FIG. 10 is a perspective view of the first core portion 40*a*. The first core portion 40*a* includes a first side-wall portion 42 with a flat plate shape. Protrusions that are a part of side circumferential portions 45 protrude from both sides of the first side-wall portion 42 in the X-axis direction. A protrusion that is a part of an inner core portion 46 protrudes from between the two side circumferential portions 45.

As shown in FIG. 10, a groove 40*c* is formed between the inner core portion 46 and the side circumferential portions 45 of the first core portion 40. The first conductive portion 20 shown in FIG. 7 is fixed into the first core portion 40*a* so that the first round-about portion 22 of the first conductive portion 20 passes through the groove 40*c* of the first core portion 40*a*.

Figure 9:
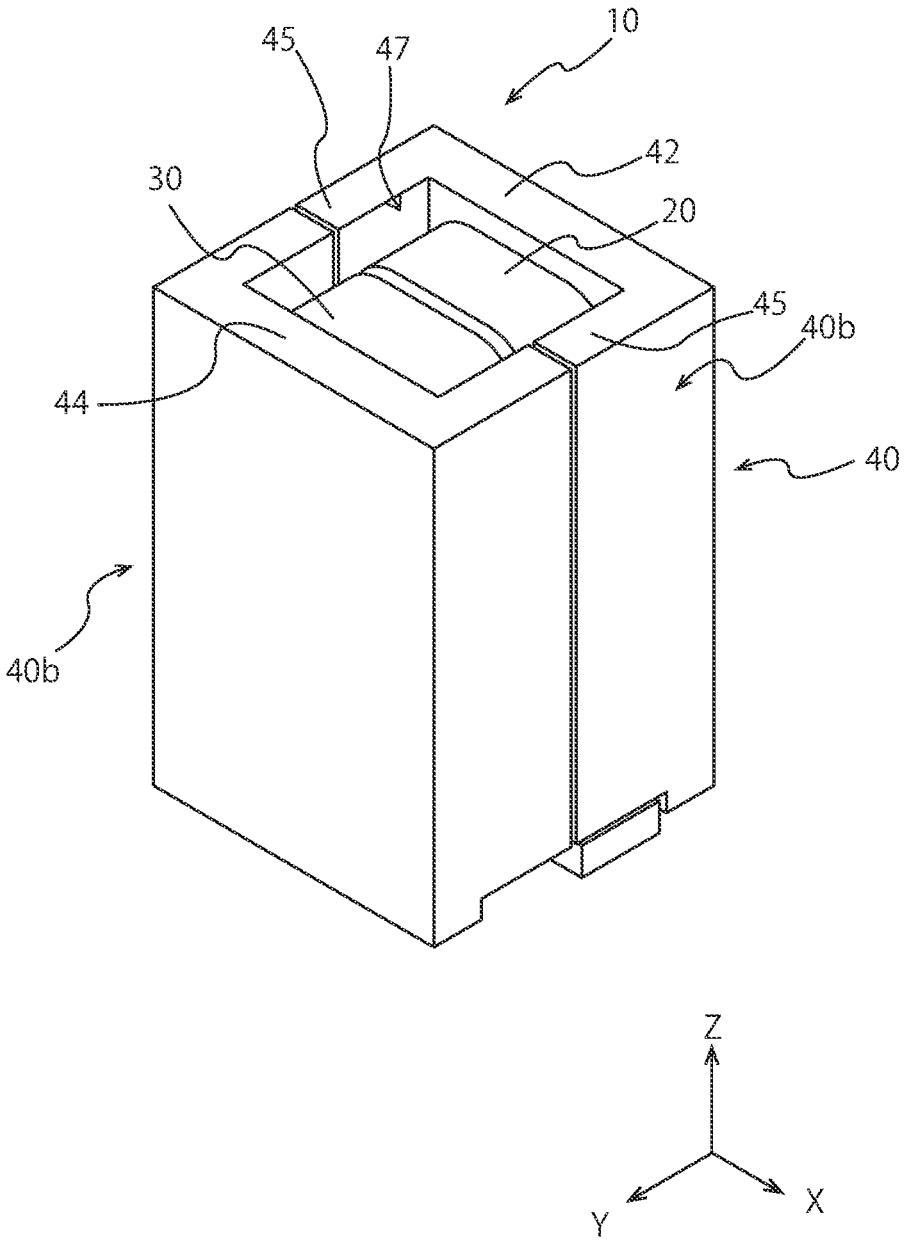
FIG. 9 is an exterior view of the inductor element shown in FIG. 1 before a tape member is attached.

The second core portion 40*b* shown in FIG. 9 has a symmetry shape to the first core portion 40*a* shown in FIG. 10. The second core portion 40*b* includes a second side-wall portion 44 disposed in parallel to the first side-wall portion 42 of the first core portion 40*a*, two protrusions protruding from both sides of the second side-wall portion 44 in the X-axis direction and being a part of the side circumferential portions 45, and a protrusion protruding from between the side circumferential portions 45 and being a part of the inner core portion 46 (not illustrated in FIG. 9).

The second conductive portion 30 is fixed into the second core portion 40*b* so that a second round-about portion 43 of the second conductive portion 30 passes through a groove of the second core portion 40*b*. The first conductive portion 20 is fixed to the first core portion 40*a*, and the second conductive portion 30 is fixed to the second core portion 40*b*. Thus, the first conductive portion 20 and the second conductive portion 30 are housed with a predetermined space in the magnetic core 40. Since the second core portion 40*b* has a symmetrical shape to the first core portion 40*a*, the second core portion 40*b* is not explained in detail in terms of inner shape.

As shown in FIG. 9, the magnetic core 40 consisting of the first and second core portions 40*a* and 40*b* includes a pair of side-wall portions consisting of the first and second side-wall portions 42 and 44 and the side circumferential portions 45 connecting the first and second side-wall portions 42 and 44 on the outside of the first and second conductive portions 20 and 30. The first and second side-wall portions 42 and 44 sandwich the first and second conductive portions 20 and 30 from both sides in the third direction D3 (Y-axis direction), where the first and second mount portions 24 and 26 shown in FIG. 8 are arranged.

Figure 2:
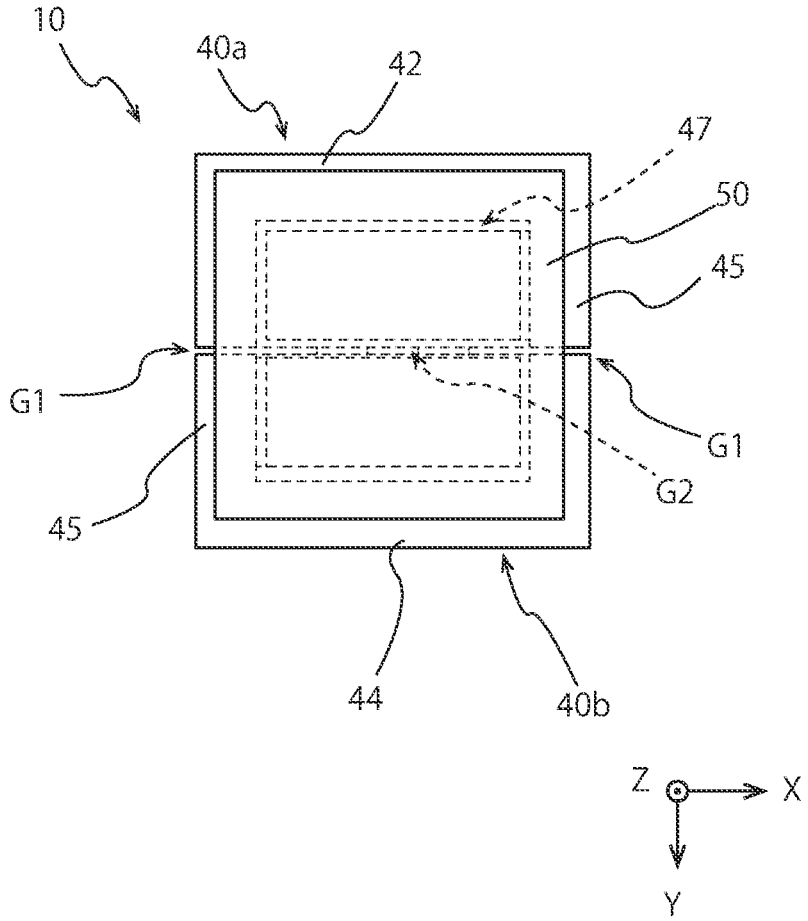
FIG. 2 is a top view of the inductor element shown in FIG. 1.
Figure 3:
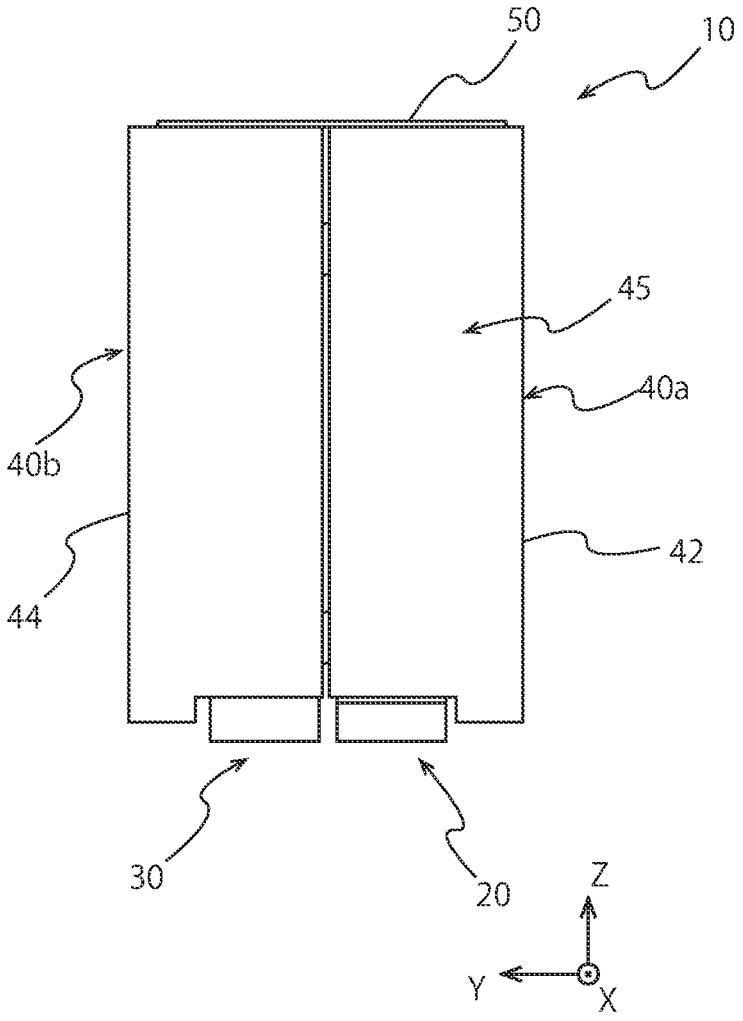
FIG. 3 is a front view of the inductor element shown in FIG. 1.

As shown in FIG. 2, the pair of side circumferential portions 45 of the magnetic core 40 surrounds the outer circumferences of the first and second conductive portions 20 and 30 along with the pair of first and second side-wall portions 42 and 44. The pair of side circumferential portions 45 connects the first and second side-wall portions 42 and 44 at both ends of the first and second side-wall portions 42 and 44 in the X-axis direction and sandwiches the first and second conductive portions 20 and 30 from both sides in the X-axis direction. The pair of side circumferential portions 45 is formed by connecting a portion housed in the first core portion 40*a* and a portion housed in the second core portion 40*b*. A magnetic gap G1 is formed at a connection part of the side circumferential portions 45 between the portion housed in the first core portion 40*a* and the portion housed in the second core portion 40*b*. For example, the magnetic gap G1 is formed by an adhesive cured portion where an adhesive connecting the first core portion 40*a* and the second core portion 40*b* is cured, other gap materials, slit, etc.

In addition to the pair of first and second side-wall portions 42 and 44 and the pair of side circumferential portions 45, as shown in FIG. 10, the magnetic core 40 includes the inner core portion 46 connecting the pair of first and second side-wall portions 42 and 44 on the inside of the first and second conductive portions 20 and 30. Similarly to the side circumferential portions 45, the inner core portion 46 of the magnetic core 40 is also formed by connecting a portion housed in the first core portion 40*a* and a portion housed in the second core portion 40*b*. Similarly to the side circumferential portions 45, as shown in FIG. 2, a magnetic gap G2 is formed at a connection part of the inner core portion 46 between the portion housed in the first core portion 40*a* and the portion housed in the second core portion 40*b*. For example, the magnetic gap G2 is formed by an adhesive cured portion where an adhesive connecting the first core portion 40*a* and the second core portion 40*b* is cured, other gap materials, slit, etc.

As shown in FIG. 9, the magnetic core 40 includes an upper opening 47 formed opposite to the side where the first to fourth mount portions 24, 26, 34, and 36 are exposed. The inductor element 10 with the upper opening 47 has excellent heat dissipation characteristics. The upper opening 47 may be covered with a tape member 50 as shown in FIG. 1 so that a mounter can stick to the upper surface of the inductor element 10. For example, the tape member 50 is made of polyimide.

The inductor element 10 shown in FIG. 1 can be manufactured by preparing the first conductive portion 20, the second conductive portion 30, the first core portion 40*a*, the second core portion 40*b*, and the tape member 50 and assembling these members. The first and second core portions 40*a* and 40*b* forming the magnetic core 40 can be made by metal or soft magnetic material of ferrite or so and may contain a binder of resin or so in addition to magnetic material.

Since a plurality of conductive portions 20 and 30 having less than 1 T is connected via the conductor pattern 60, the inductor element 10 shown in FIG. 1 can achieve an L value equivalent to that of an element having more than 1 T and high magnetic saturation characteristics using conductive portions having a large cross sectional area, a low resistance, and a simple structure. Since the first mount portion 24 of the first conductive portion 20 and the third mount portion 34 of the second conductive portion 30 are overlapped with each other in the third direction D3 as shown in FIG. 8, the inductor element 10 can be mounted using a simple conductor pattern 60 and is advantageous in downsizing. Since the distance between the first mount portion 24 and the third mount portion 34 connected by the third land 63 can be reduced, it is possible to prevent the increase in resistance value caused by flow of electric current in the third land 63.

Second Embodiment

Figure 11:
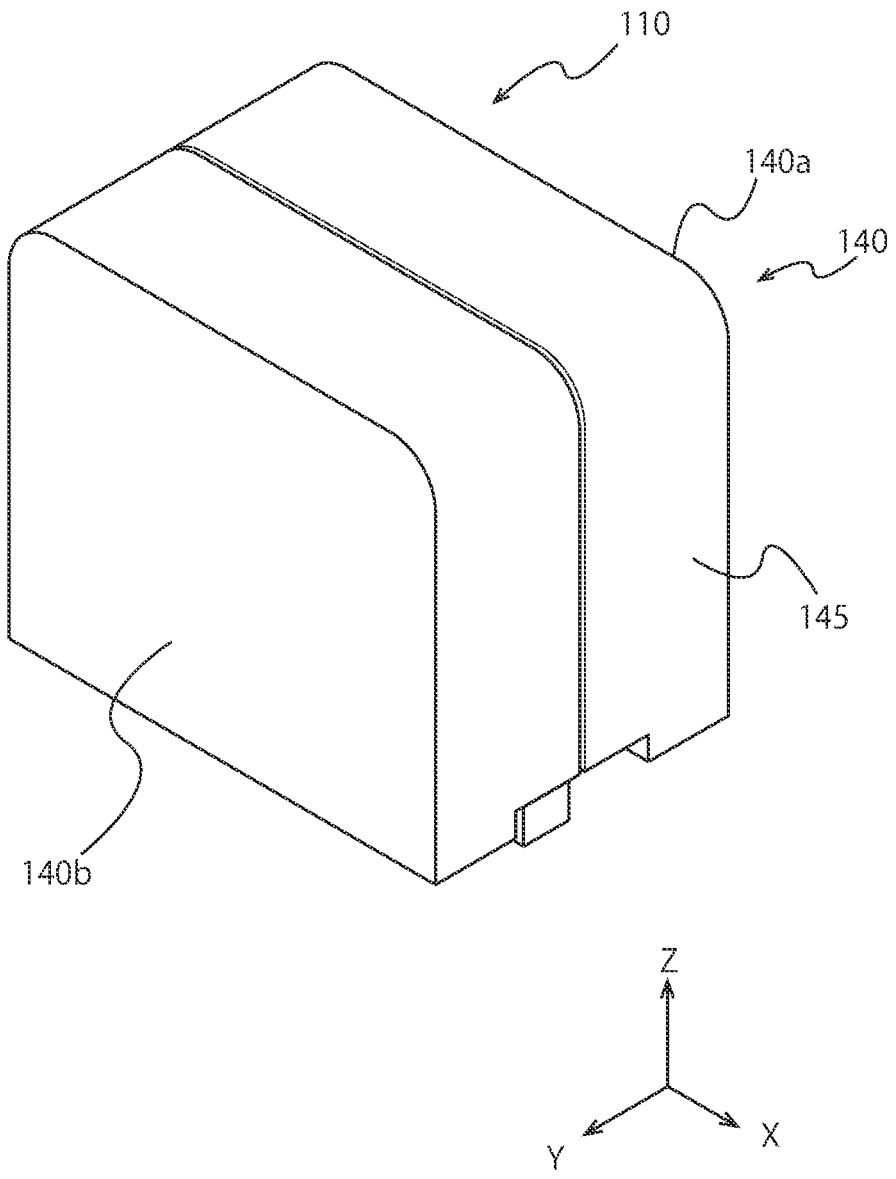
FIG. 11 is a perspective view of an inductor element according to Second Embodiment of the present invention seen from diagonally above.

FIG. 11 is an exterior view of an inductor element 110 according to Second Embodiment of the present invention. The inductor element 110 is similar to the inductor element 10 shown in FIG. 1 except that no upper opening is formed in a magnetic core 140, and that first and second conductive portions 120 and 130 housed in the magnetic core 140 have different detailed shape. Thus, the inductor element 110 is explained in terms of only differences from the inductor element 10 and is not explained in terms of common matters with the inductor element 10.

Figure 12:
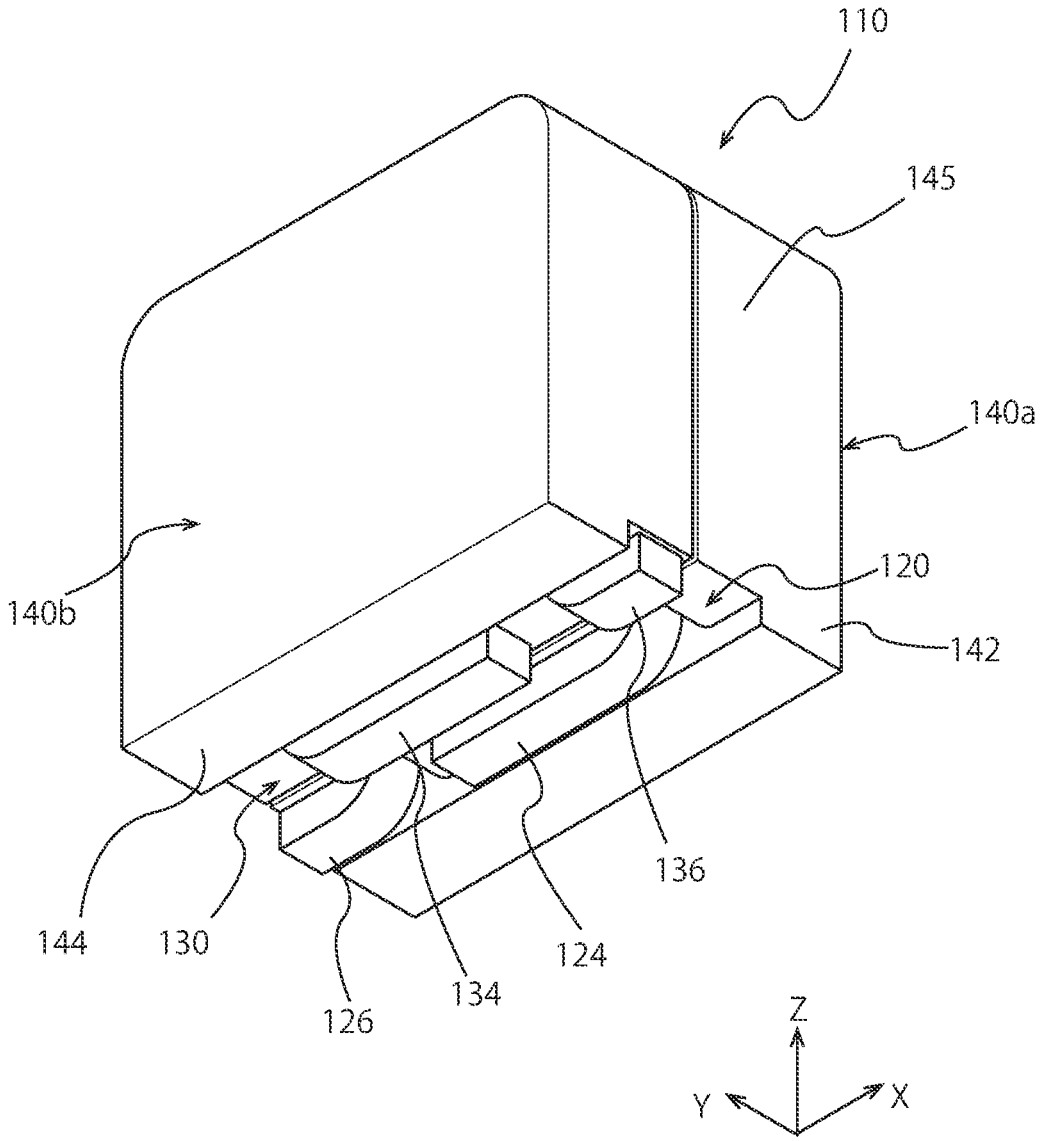
FIG. 12 is a perspective view of the inductor element shown in FIG. 11 seen from diagonally below.

As shown in FIG. 11, the magnetic core 140 of the inductor element 110 is formed by combining first and second core portions 140*a* and 140*b* (different members). As shown in FIG. 11 and FIG. 12, side circumferential portions 145 connect a first side-wall portion 142 of the first core portion 140*a* and a second side-wall portion 144 of the second core portion 140*b* at both sides of the magnetic core 140 in the X-axis direction and at three side parts of the magnetic core 140 on the positive side of the Z-axis direction.

Figure 13:
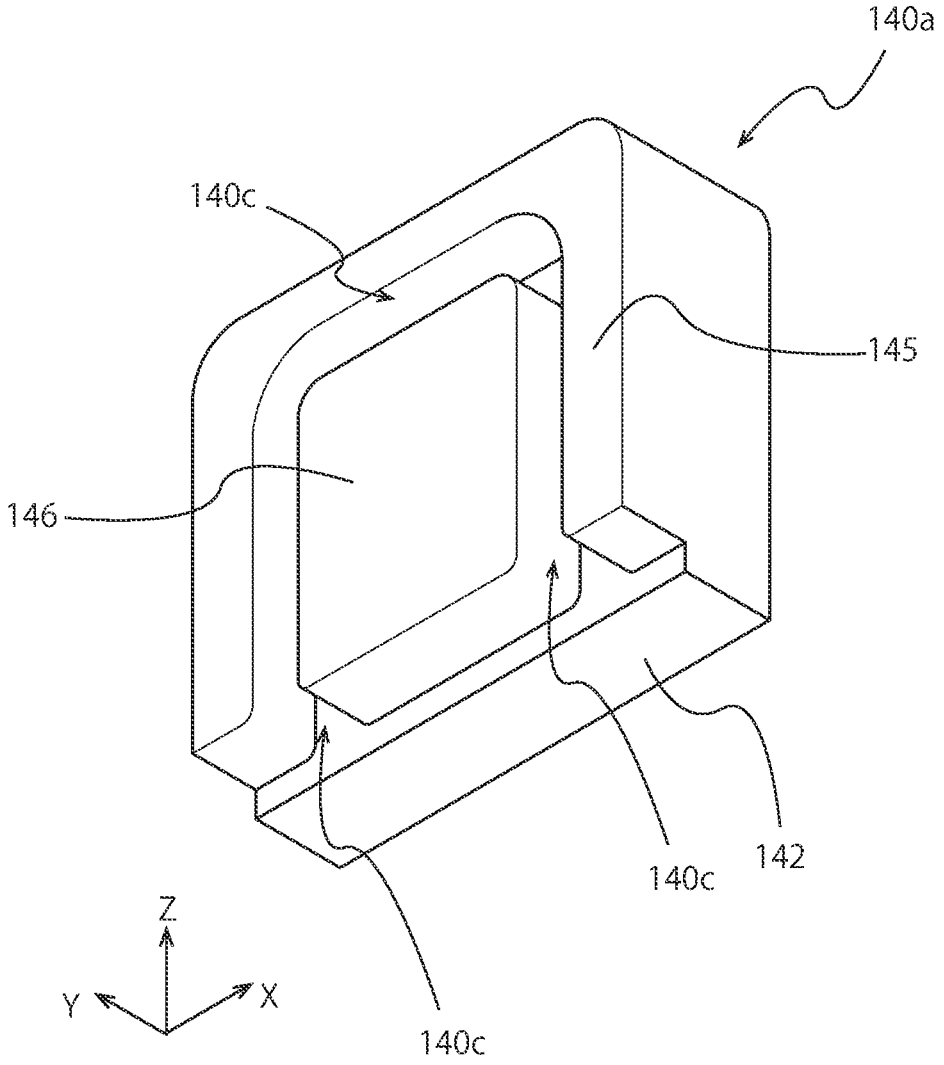
FIG. 13 is an exterior view of a first core portion housed in a magnetic core of the inductor element shown in FIG. 11

As shown in FIG. 13, a U-shaped groove 140*c* passed by a first round-about portion (not illustrated) of the first conductive portion 120 shown in FIG. 12 is formed in the first core portion 140*a*. An inner core portion 146 of the magnetic core 140 passes through the first and second conductive portions 120 and 130 and connects the first side-wall portion 142 of the first core portion 140*a* and the second side-wall portion 144 of the second core portion 140*b*.

As shown in FIG. 12 (a perspective view of the inductor element 110 from below), similarly to the first and second conductive portions 20 and 30 shown in FIG. 8, the first and second conductive portions 120 and 130 are housed in the magnetic core 140 so that each mount surface of first to fourth mount portions 124, 126, 134, and 136 is exposed. The first and second conductive portions 120 and 130 are different from the first and second conductive portions 20 and 30 shown in FIG. 8 in that the outer shape of the round-about portion and the cross-sectional shape of the conductive portions are a foursquare or a foursquare-like rectangle, but are similar to the first and second conductive portions 20 and 30 in other matters.

The inductor element 110 according to Second Embodiment shown in FIG. 11 demonstrates effects similar to those of the inductor element 10 shown in FIG. 1. Incidentally, a tape member similar to that of the inductor element 10 may be attached to the surface of the inductor element 110 on the positive side of the Z-axis direction. Whether the magnetic core 40 (140) has the shape of FIG. 9 (the upper opening 47 is formed) or has the shape of FIG. 11 (the upper surface of the inductor element 110 is covered with the side circumferential portions 145) may be determined based on heat dissipation characteristics, handling characteristics, magnetic saturation characteristics, etc. required for the inductor element 10 (110).

The present invention is explained above with the embodiments, but is not limited to the above-mentioned embodiments and, needless to say, includes many other embodiments. For example, the first and second conductive portions 20 and 30 housed in the magnetic core 40 are not limited to only one obtained by pressing or processing a conductor plate or a rectangular wire having a constant width in the Y-axis direction as shown in FIG. 7 into the shape like alphabet "Q" or number "9".

Figure 14:
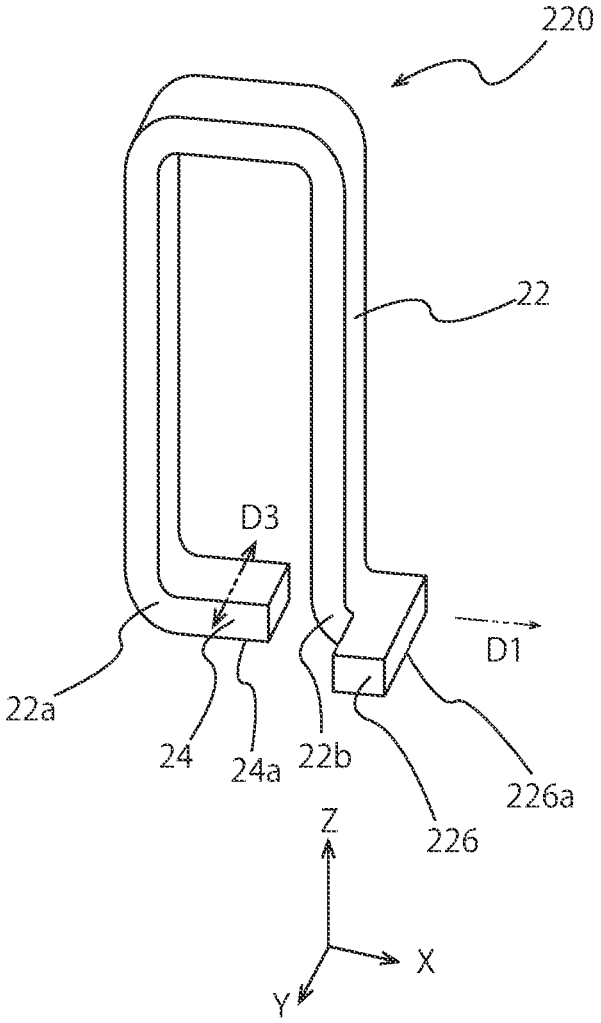
FIG. 14 is an exterior perspective view of a first conductive portion according to a modified example.

FIG. 14 is a schematic perspective view illustrating a first conductive portion 220 according to a modified example. The first conductive portion 220 is similar to the first conductive portion 20 shown in FIG. 7 in terms of the first round-about portion 22 and the first mount portion 24, but a second mount portion 226 has a different shape from the second mount portion 26 shown in FIG. 7.

As shown in FIG. 14, the second mount portion 226 protrudes from the first round-about portion 22 in the Y-axis direction, and a second mount surface 226*a* of the second mount portion 226 has a width in the third direction D3 that is larger than a width in the third direction D3 of the first mount surface 24*a* of the first mount portion 24. Instead of the first and second conductive portions 20 and 30 shown in FIG. 8, the magnetic core 40 shown in FIG. 1 may house the first and second conductive portions 220 including second and fourth mount surfaces 226*a* whose width in the third direction D3 is larger than that of the mount surface 24*a* of the first and third mount portions as shown in FIG. 7. The inductor element according to such a modified example is more stable and hard to fall down while being placed with mount posture and thereby has a more favorable mounting performance.

NUMERICAL REFERENCES

10, 110 . . . inductor element
20, 120 . . . first conductive portion
22 . . . first round-about portion
22*a* . . . first end
22*b* . . . second end
24, 124 . . . first mount portion
24*a* . . . first mount surface
24*b* . . . tip
26, 126 . . . second mount portion
26*a* . . . second mount surface
26*b* . . . tip
30, 130 . . . second conductive portion
32 . . . second round-about portion
32*a* . . . third end
32*b* . . . fourth end
34, 134 . . . third mount portion
34*a* . . . third mount surface
34*b* . . . tip
36, 136 . . . fourth mount portion
36*a* . . . fourth mount surface
36*b* . . . tip
40, 140 . . . magnetic core
40*a*, 140*a* . . . first core portion
40*b*, 140*b* . . . second core portion
40*c*, 140*c* . . . groove
42, 142 . . . first side-wall portion
44, 144 . . . second side-wall portion
45, 145 . . . side circumferential portion
46, 146 . . . inner core portion
47 . . . upper opening
48 . . . lower opening
50 . . . tape member
60 . . . conductor pattern
61 . . . first land
62 . . . second land
63 . . . third land
D1 . . . first direction
D2 . . . second direction
D3 . . . third direction
G1 . . . outer magnetic gap
G2 . . . inner magnetic gap

What is claimed is:

1. An inductor element comprising:

a first conductive portion including:

a first round-about portion connecting a first end and a second end in a round-about manner;

a first mount portion connected to the first round-about portion at the first end and extending from the first end in a first direction linearly passing through the second end from the first end;

a second mount portion connected to the first round-about portion at the second end and extending from the second end in the first direction; and a first tip of the first mount portion that is positioned between the first end and the second end;

a second conductive portion including:

a second round-about portion connecting a third end and a fourth end in a round-about manner;

a third mount portion connected to the second round-about portion at the third end and extending from the third end in a second direction linearly passing through the fourth end from the third end;

a fourth mount portion connected to the second round-about portion at the fourth end and extending from the fourth end in the second direction; and a second tip of the third mount portion that is positioned between the third end and the fourth end; and a magnetic core configured to house at least a part of the first conductive portion and the second conductive portion so that each mount surface of the first to fourth mount portions is exposed from one side of the magnetic core, the magnetic core including:

a pair of side-wall portions sandwiching the first conductive portion and the second conductive portion from both sides of a third direction perpendicular to the first direction and the second direction;

an inner core portion connecting the pair of side-wall portions on an inside of the first conductive portion and the second conductive portion; and a pair of side circumferential portions connecting the pair of side-wall portions on an outside of the first conductive portion and the second conductive portion, wherein the first conductive portion and the second conductive portion are arranged so that the first direction and the second direction are substantially parallel and opposite to each other, the first mount portion and the third mount portion are at least partially overlapped with each other in the third direction, and the first mount portion and the third mount portion are configured to be electrically connected to each other.

2. The inductor element according to claim 1, wherein a magnetic gap is formed in the inner core portion.

3. The inductor element according to claim 1, wherein a magnetic gap is formed in the pair of side circumferential portions.

4. The inductor element according to claim 1, wherein the magnetic core includes an upper opening formed opposite to the side where each mount surface of the first to fourth mount portions is exposed.

5. The inductor element according to claim 4, wherein the upper opening is covered with a tape member.

6. The inductor element according to claim 1, wherein the first conductive portion and the second conductive portion have the same exterior shape and are arranged symmetrically to each other.

7. The inductor element according to claim 1, wherein mount surfaces of the second and fourth mount portions are wider than those of the first and third mount portions in the third direction.

8. The inductor element according to claim 1, wherein mount surfaces of the first and third mount portions are longer than those of the second and fourth mount portions in the first or second direction.

9. The inductor element according to claim 1, wherein the first conductive portion and the second conductive portion are a rectangular wire or a bent conductive plate.

10. The inductor element according to claim 1, wherein at least a part of the first mounting portion, the second mounting portion, the third mounting portion, and the fourth mounting portion is overlapped with the pair of side-wall portions in the third direction.

11. The inductor element according to claim 1, wherein a tip of the second mount portion and a tip of the fourth mount portion are arranged below the inner core portion.

12. The inductor element according to claim 1, wherein a tip of the first mount portion is below one of the pair of side circumferential portions, and a tip of the third mount portion is below other of the pair of side circumferential portions.

* * * * *